US009932755B2

(12) United States Patent
Niccole et al.

(10) Patent No.: US 9,932,755 B2
(45) Date of Patent: Apr. 3, 2018

(54) DOOR SECURITY DEVICE

(71) Applicants: Devon Niccole, Huntington Beach, CA (US); David Robert Millar, Aliso Viejo, CA (US); Chris Alan Marsh, Huntington Beach, CA (US)

(72) Inventors: Devon Niccole, Huntington Beach, CA (US); David Robert Millar, Aliso Viejo, CA (US); Chris Alan Marsh, Huntington Beach, CA (US)

( * ) Notice: Subject to any disclaimer, the term of this patent is extended or adjusted under 35 U.S.C. 154(b) by 393 days.

(21) Appl. No.: 14/592,230

(22) Filed: Jan. 8, 2015

(65) Prior Publication Data

US 2016/0201355 A1 Jul. 14, 2016

(51) Int. Cl.
*E05B 15/02* (2006.01)
*E05B 17/20* (2006.01)

(52) U.S. Cl.
CPC ..... *E05B 17/2003* (2013.01); *E05B 15/0205* (2013.01)

(58) Field of Classification Search
CPC ..... E05B 17/2003; E05B 15/0205
See application file for complete search history.

(56) References Cited

U.S. PATENT DOCUMENTS 4,017,106 A * 4/1977 Salazar ..... E05B 15/0205 292/340
2012/0060423 A1* 3/2012 Fulton ..... E05B 15/0205 49/460

* cited by examiner

*Primary Examiner* — Matthieu F Setliff
*Assistant Examiner* — Thomas L Neubauer
(74) *Attorney, Agent, or Firm* — Richard J. Hepner

(57) ABSTRACT

In combination with a door, a door jamb and a latch bolt, a door security device for preventing the jimmying of a door latch bolt comprising a strike plate; a barrier plate comprising a base portion, a barrier portion and a hinge providing mechanical connection between said base portion and said barrier portion, the barrier plate designed and configured to conform to and fill the gap formed between the door and the door jamb upon closing the door into the door jamb; and one or more fasteners for installing the door security device into the door jamb.

8 Claims, 4 Drawing Sheets

DOOR SECURITY DEVICE

FIELD OF THE INVENTION

The present invention relates generally to the field of door security. More particularly, the present invention provides a useful and novel apparatus to prevent jimmying of a door lock. The apparatus according to the present invention is designed and configured to provide a positive physical barrier to defeat a jimmy; to be simply installed and/or replaced into an existing door jamb, with no modification to the door jamb, using only a tool to remove and install fasteners, such as a screwdriver; to be flexible in order to conform to various door jamb/door combination tolerances; and to be wholly contained between the edge of the door and the door jamb thereby preventing access to the device by a potential trespasser desiring to defeat the device by means of a pry bar or other tool.

BACKGROUND OF THE INVENTION

Unless specifically indicated otherwise, the materials described in this section are not prior art to the claims in this application, and are not admitted to be prior art by inclusion in this section.

The material in this patent document is subject to copyright protection under the copyright laws of the United States and other countries. The copyright owner grants a limited license to any member of the public to reproduce the patent document as it appears in official governmental records. All other copyrights rights are reserved.

Persons, such as would-be thieves or trespassers, often employ a tool called a "jimmy" to open a locked door. Typically, a thin flexible tool, such as a credit card, is used as a jimmy. The jimmy is inserted into the gap between a closed and locked door and the door jamb and pressed against the latch bolt, thereby causing the latch bolt to withdraw from the door jamb and the door to be unlocked.

A number of devices have been disclosed in the conventional art to address the problem of the jimmying of door locks (also referred to as credit card entry) by a person using a jimmy, such as a credit card or a similar tool. Each of these conventional art devices suffers limitations and disadvantages.

One approach to address the problem of credit card entry is to design an entire jimmy-proof door lock mechanism. U.S. Pat. No. 4,031,725 to Reid is representative of this general approach. Reid discloses a door lock that utilizes a standard keyed lock assembly in combination with a latch fitted in sliding relationship with a channel shaped dead bolt member such that, when the dead bolt is extended over the latch into the door jamb opening, the door is secured against unauthorized entry commonly accomplished by the use of credit cards and the like. The invention of Reid further comprises linkage and latch assemblies for manipulating the late and dead bolt sleeve. Practical disadvantages and limitations of such inventions include that they are not designed to be readily adapted to, or used in combination with, existing conventional door locks and door latch devices. Therefore, use of such inventions requires the considerable expense of purchasing an entire door lock assembly, and the considerable cost, inconvenience, and mechanical challenge of replacing the existing door lock with the jimmy-proof door lock. Such inventions are not suitable after-market solutions to the problem of credit card entry. In addition, such inventions are complex and expensive to manufacture.

Another approach to solving the problem of credit card entry is to provide a physical barrier to the jimmy. An example of this approach is U.S. Pat. No. 3,936,085 to Long. Long discloses a lock protector consisting of a strong metal door plate of U-form adapted to bridge the free edge of a door at the lock and aperture to pass the lock bolt, and a chain plate adapted to be strongly affixed to the door frame, the safety chain being permanently affixed to the door plate and detachably connected to the chain plate. Additionally, the chain plate has a fixed metal flange, formed integrally to the strong metal chain plate, intended to defeat credit card entry. Practical disadvantages and limitations of the invention of Long dictate that the device is not a practical after-market solution to the problem of credit card entry. The device of Long is mechanically complex and accordingly expensive. Further, the device of Long may not be installed on an existing door/door jamb assembly without inconvenient and challenging modification of the door/door jamb assembly. In addition, the device of Long is fully accessible to a potential intruder and, therefore, may be defeated by such potential intruder with a tool to pry the protective flange. Finally, the device of Long does not accommodate various door-to-door jamb gap tolerances.

What is needed is a door security device that: defeats jimmying (or credit card entry); is compatible with the door security after-market; is adapted for use on existing door-door jamb installations; is simply installed without modification of the existing door-door jamb installation; accommodates a variety of door-to-door jamb gaps; prevents a jimmy from reaching the door latch bolt from above or below the latch bolt; cannot be accessed and defeated by a potential intruder; and is low cost.

SUMMARY OF THE INVENTION

In view of the foregoing limitations and disadvantages inherent to the conventional art, the present invention provides a novel and useful door security device that defeats jimmying (or credit card entry); is compatible with the door security after-market; is adapted for use on existing door-door jamb installations; is simply installed without modification of the existing door-door jamb installation; accommodates a variety of door-to-door jamb gaps; prevents a jimmy from reaching the door latch bolt from above or below the latch bolt; cannot be accessed and defeated by a potential intruder; and is low cost.

One objective of the present invention is to defeat jimmying (or credit card entry).

In one aspect of the present invention, a barrier portion provides a positive physical barrier against access of a jimmy to a door latch bolt.

In another aspect of the present invention, the barrier portion further comprises notches on the top and bottom edges of the barrier portion to prevent access of a jimmy to a door latch bolt.

In still another aspect of the present invention, a top barrier and a bottom barrier provide positive physical barriers against access of a jimmy to a door latch bolt.

Another objective of the present invention is to prevent access to the door security device by a potential trespasser who might defeat the device by means of a pry bar or other tool.

In one aspect of the present invention, the door security device is wholly contained between the edge of a door and a door jamb, thereby preventing access to the device by a pry bar or other tool.

Another objective of the present invention is to provide a device that is compatible with the door security aftermarket: is adapted to use on existing door-door jamb installations, and is simply installed and/or replaced without modification of the existing door-door jamb installation.

In one aspect of the present invention, a door security device utilizes a modified strike plate that simply replaces the strike plate of an existing door, using the existing strike plate fasteners or replacement fasteners.

An additional objective of the present invention is to accommodate a variety of door-to-door jamb gap tolerances.

In one aspect of the present invention, a door security device comprises a barrier plate having a base portion, a barrier portion and a hinge providing mechanical connection between said base portion and said barrier portion, the barrier plate designed and configured to conform to and fill the gap formed between the door and the door jamb upon closing the door into the door jamb.

Other objects, aspects and advantages of the present invention will become readily apparent to those with skill in the art from the following figures, descriptions and claims. As will be appreciated by those with skill in the relevant art, the door security device of the present invention may be implemented in a plurality of equivalent embodiments. Such alternative embodiments, and their attendant objects, aspects and advantages, are within the scope of the present invention and, therefore, the examples set forth herein shall not be limiting.

BRIEF DESCRIPTION OF THE DRAWINGS

The nature of this invention, as well as all its objects, aspects and advantages, will become readily apparent and understood upon reference to the following detailed description when considered in conjunction with the accompanying drawings, in which like reference numerals designate like parts throughout the figures thereof, and wherein.

DETAILED DESCRIPTION OF THE INVENTION

The following description is provided to enable a person skilled in the relevant art to make and use the invention, and sets forth the best modes contemplated by the inventor of carrying out the invention. The present invention shall not be limited to the examples disclosed. Rather, the scope of the invention shall be as broad as the claims will allow.

Various inventive features are described below that may each be used independently of one another or in combination with other features. However, any single inventive feature may not address any of the disadvantages or objects discussed above, or might address only one of the disadvantages or objects discussed above. Further, one or more of the disadvantages or objects discussed above may not be fully addressed by any of the features described below.

Figure 1:
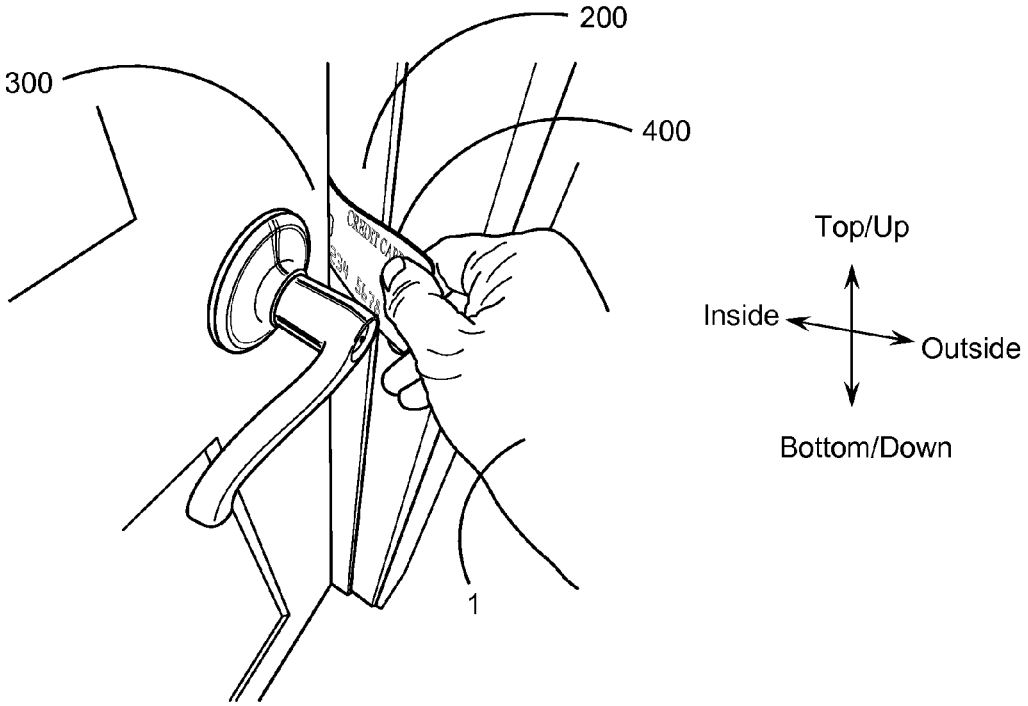
FIG. 1 presents a perspective view of a person using a jimmy to access a door latch bolt.
Figure 2:
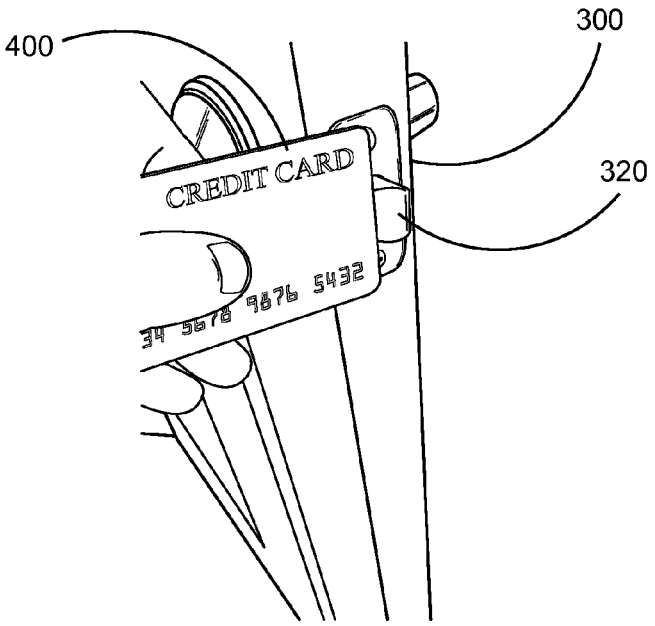
FIG. 2 presents a perspective view of a jimmy engaging a door latch bolt.

Referring now to the drawings, FIG. 1 and FIG. 2 are provided to enhance understanding of the background of the invention. FIG. 1 presents a perspective view of a person 1 using a jimmy 400 to access a door latch bolt (not shown). The person 1 accesses the door latch bolt by sliding a jimmy 400 between a door 300 and a door jamb 200.

FIG. 2 presents a perspective view of a jimmy 400 engaging a door latch bolt 320. As the jimmy 400 is pressed against the door latch bolt 320, the door latch bolt 320 is forced into the door 300, thereby causing the door 300 to be unlocked.

Figure 3:
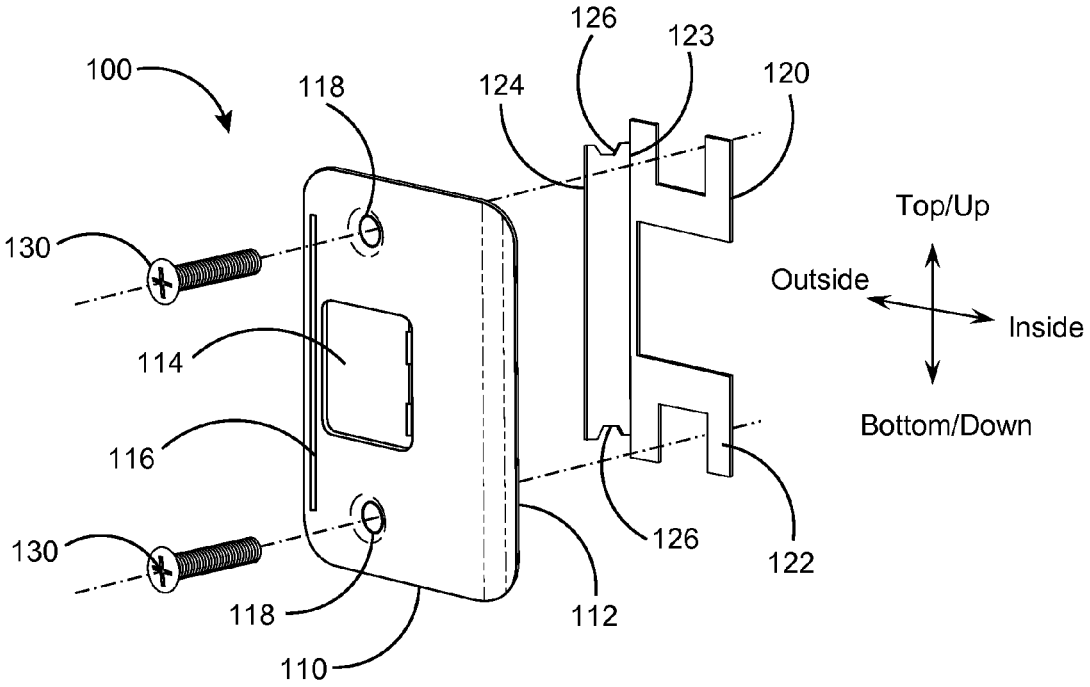
FIG. 3 presents an exploded perspective view of a door security device, according to one exemplary embodiment of the present invention.

FIG. 3 presents an exploded perspective view of a door security device 100, according to one exemplary embodiment of the present invention. The door security device 100 may comprise a strike plate 110, a barrier plate 120, and one or more fasteners 130.

Figure 4:
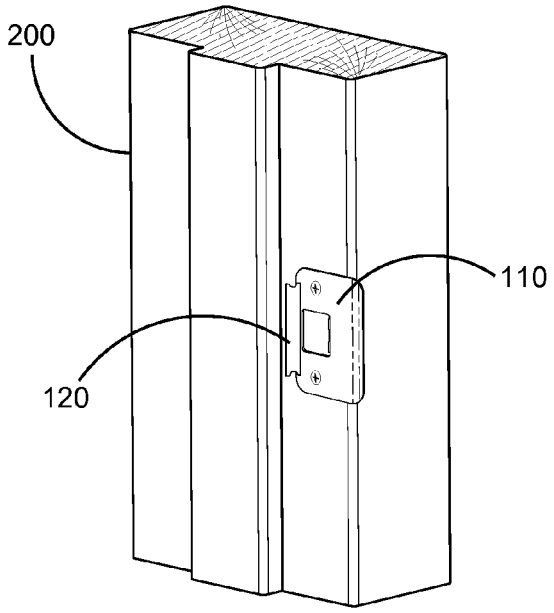
FIG. 4 presents a perspective view of the door security device of FIG. 3 installed into a door jamb and ready for use.

FIG. 4 presents a perspective view of the door security device 100 installed into a door jamb 200 and ready for use.

Figure 5:
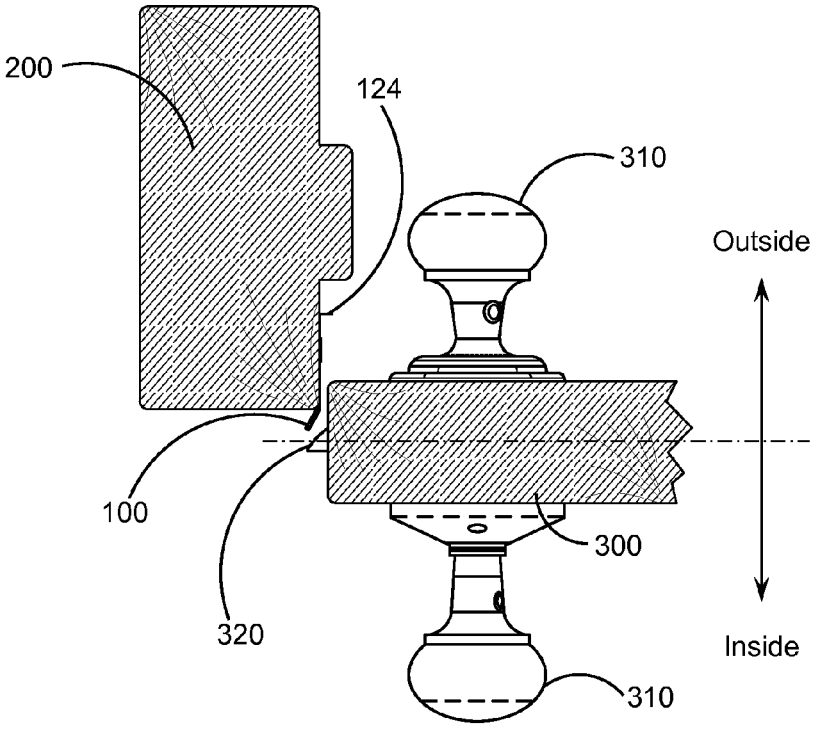
FIG. 5 presents a view of the door security device of FIG. 3 installed into a door jamb, with an opened door positioned to close and engage the door security device.

FIG. 5 presents a view of the door security device 100 installed into a door jamb 200, with an opened door 300 positioned to close and engage the door security device 100.

Figure 6:
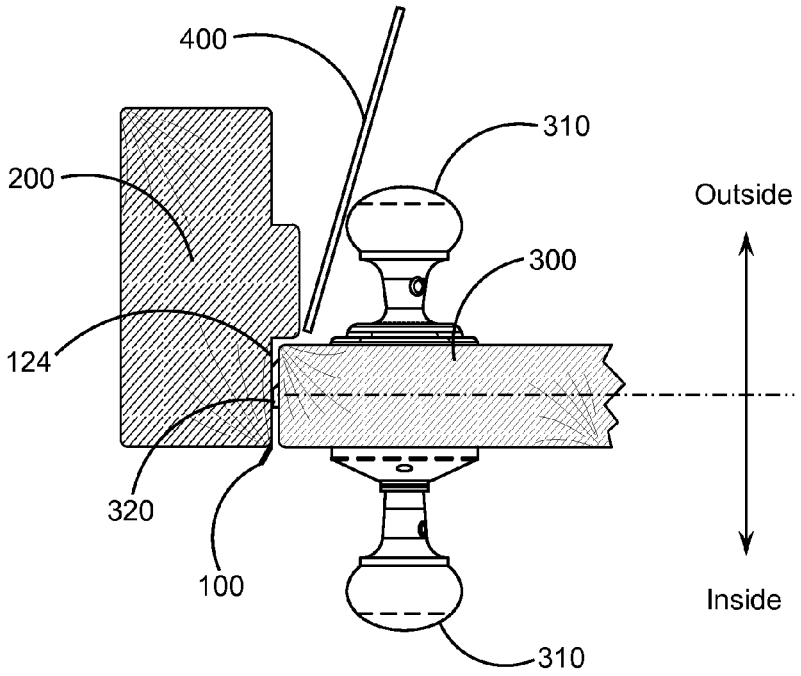
FIG. 6 presents a view of the door security device of FIG. 3 installed into a door jamb with a door in a closed position and engaging the door security device.

FIG. 6 presents a view of the door security device 100 installed into a door jamb 200 with a door 300 in a closed position and engaging the door security device 100.

Figure 7:
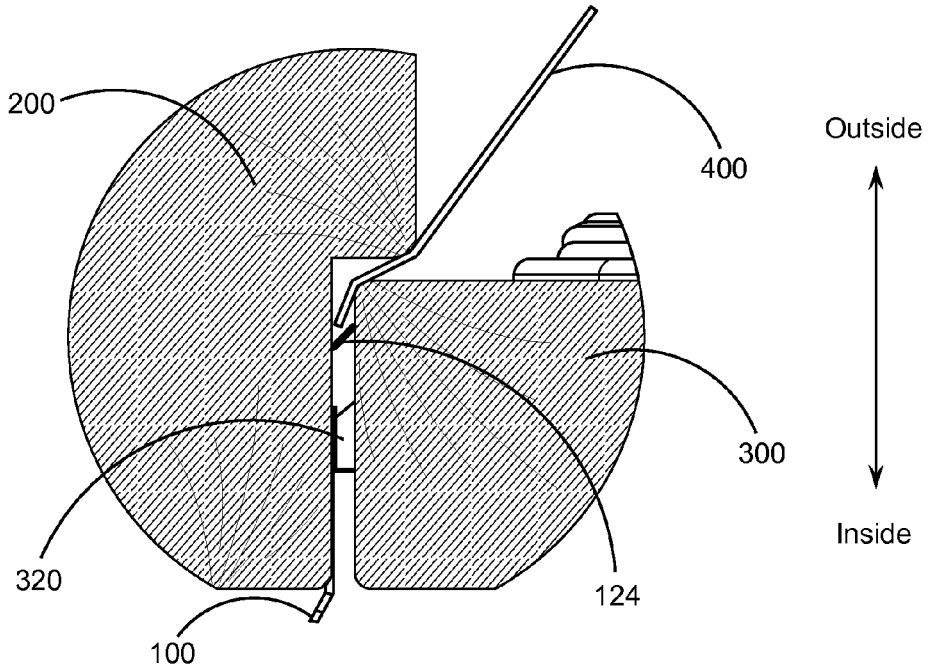
FIG. 7 presents a detailed view of the door security device of FIG. 3 in use defeating a jimmy.

FIG. 7 presents a detailed view of the door security device 100 in use defeating a jimmy 400.

Returning now to FIG. 3, the barrier plate 120 may have a base portion 122 and a barrier portion 124. A hinge 123 may provide mechanical connection between said base portion 122 and said barrier portion 124, and position said barrier portion 124 in a generally perpendicular orientation with respect to said base portion 122.

The base portion 122 may be designed to be captured between the strike plate 110 and the door jamb 200 (not shown), and to provide mechanical support to the barrier portion 124.

The barrier portion 124 may, upon installation of the door security device 100, be inserted through a slot 116 in the strike plate 110, thereby protruding into the gap between a door 300 (not shown) and a door jamb 200 (not shown). The barrier portion 124 may be made of a flexible material to enable the barrier 124 to deflect when a door 300 is closed, thereby having the ability to conform to a variety of door-to-door jamb gaps, and forming a generally v-shaped barrier to capture the leading edge of a jimmy 400 and prevent passage of the jimmy 400 to a latch bolt 320 (not shown).

The barrier plate 120 may be made of any material suitable to its intended function, including but not limited to plastic or spring steel.

The barrier plate 120 may be formed from one integral piece of material, or manufactured from two or more component parts.

The hinge 123 may be formed integrally with the base portion 122 and/or the barrier portion 124, or may be a separate component.

In one preferred embodiment, the barrier plate 120 may function as a cantilever spring, the barrier portion 124 being cantilevered, and the hinge 123 may be made of a flexible, resilient material such as plastic or spring steel. In this embodiment, the angle formed between the hinged base portion 122 and barrier portion 124 may be any angle greater than zero, with the preferred effective angle being in the range of about 30 degrees to 90 degrees.

The strike plate 110 may be designed to replace the existing strike plate on a door, have a striking edge 112, a latch receiver 114, and one or more fastener holes 118, as do existing strike plate designs.

The striking edge 112 is designed to engage and depress the latch bolt 320 of the door 300 as the door 300 closes against the door jamb 200, thereby allowing the door 300 to close.

The latch receiver 114 is designed to accept the latch bolt 320, enabling the latch bolt 320 to engage into the latch receiver 114, thereby allowing the door 300 to lock in the closed position.

The one or more fastener holes 118 accommodate the one or more fasteners 130 that secure the strike plate 110 to the door jamb 200.

The strike plate 110 may have a unique slot 116 that is not found on existing strike plates. The slot 116 is designed to accept the barrier portion 124 of the barrier plate 120, thereby positioning the barrier portion 124 for use within the door-to-door jamb gap.

In one alternative of the present invention, the barrier portion 124 may have a notch 126 incorporated into the top and bottom edges of the barrier portion 124. The notches 126 function to prevent a jimmy 400 from being inserted behind the barrier 124 from above or below the barrier 124, thereby defeating the barrier portion 124 and unlocking the door 300. The notches 126 achieve their purpose by capturing the edge of the jimmy 400 and preventing the jimmy 400 from sliding behind the barrier portion 124.

In one embodiment of the present invention, the door security device 100 may be simply and easily installed into an existing door jamb, with no modification to the door jamb, using only a tool to remove and install fasteners, such as a screwdriver, according to the following steps:

Step 1. Removing the existing strike plate from the door jamb by unfastening the existing fastener(s) that hold the existing strike plate in place.

Step 2. Aligning the door security device 100 to the door jamb, in the position vacated by the existing strike plate, such that the barrier plate 120 is captured between the strike plate 110 and the door jamb, and the barrier portion 124 of the barrier plate 120 is inserted through the slot 116 of the strike plate 110.

Step 3. Securing the door security device 100 to the door jamb by means of the fastener(s) 130.

A method of using the door security device 100 may include the following steps:

Step 1. Obtaining a door security device 100;

Step 2. Installing the door security device 100 into a door jamb by means of one or more fasteners 130;

Step 3. Closing a door into the door jamb, thereby causing the barrier portion 124 of the door security device 100 to conform to and fill the gap formed between the door and the door jamb upon closing said door, the barrier portion 124 being contained between the edge of the door and the door jamb, thereby preventing access of a jimmy to the latch bolt 320, or access to the door security device 100 by a prying tool.

This method of using the door security device 100 is illustrated in FIGS. 5-7.

Figure 8:
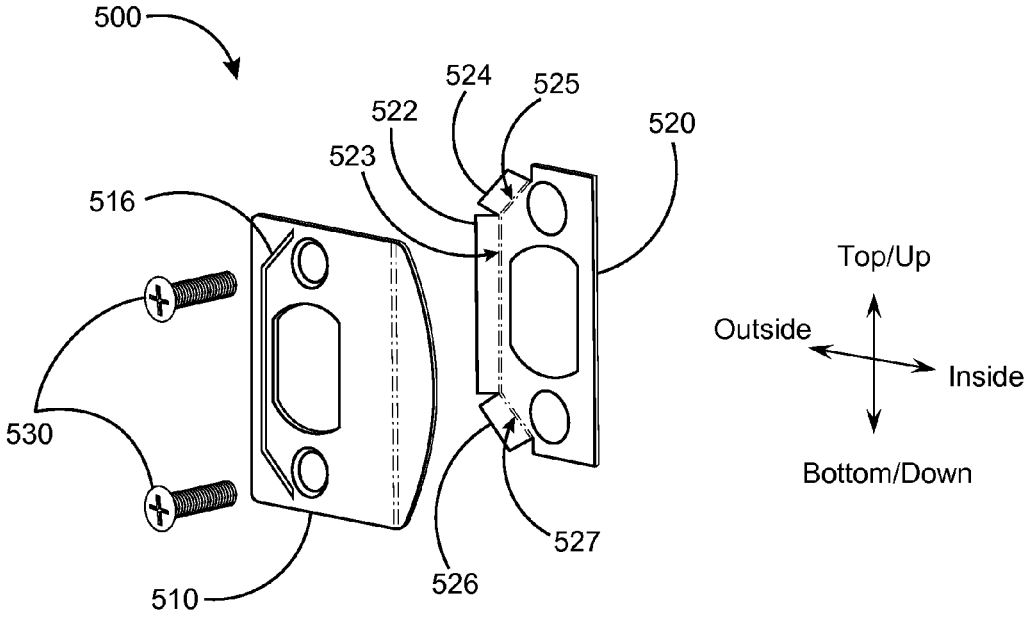
FIG. 8 presents an exploded perspective view of a door security device, according to another exemplary embodiment of the present invention.

FIG. 8 presents an exploded perspective view of a door security device 500, according to another exemplary embodiment of the present invention. In this alternative embodiment, a top barrier 524 may be added to the barrier plate 520 by means of a top hinge 525, the top barrier 524 being designed and configured to prevent access by a jimmy to a latch bolt from above. A bottom barrier 526 may be added to the barrier plate 520 by means of a bottom hinge 527, the bottom barrier 526 being designed and configured to prevent access by a jimmy to a latch bolt from below. The slot 516 in the strike plate 510 may be configured to accommodate the barrier portion 522, the top barrier 524, and the bottom barrier 526.

As will be appreciated by those with skill in the related arts, the individual elements of the disclosed invention may be modified, interchanged or combined, or additional elements added, without departing from the spirit of the invention. Further, the present invention may be practiced in alternative embodiments other than those illustrated in the Figures. Such modifications, combinations, additions and alternatives are within the contemplation of the present invention. The exemplary embodiments disclosed are not intended to limit the scope of this invention. Accordingly, the scope of the invention should be determined not by the embodiments illustrated, but by their legal equivalents, and shall be as broad as the claims will allow.

What is claimed is:

1. In combination with a door, a door jamb and a latch bolt, a door security device for preventing the jimmying of a door lock, the device comprising:

(a) a strike plate, said strike plate comprising a striking edge, a pass-through slot, said pass-through slot being an aperture fully enclosed by and passing-through said strike plate, one or more fastener holes, and a latch receiver, said latch receiver disposed between said striking edge and said pass-through slot;

(b) a barrier plate having a top end and a bottom end, said barrier plate comprising:

(i) a planar base portion;

(ii) a planar barrier portion configured to prevent access of a jimmy to said latch bolt; and (iii) a hinge providing mechanical connection between said planar base portion and said planar barrier portion, and positioning said planar barrier portion in a generally perpendicular orientation with respect to said planar base portion;

said planar barrier portion configured to conform to and fill the gap formed between said door and said door jamb upon closing said door; and (c) one or more fasteners;

said door security device assembled and installed such that said one or more fasteners mechanically fasten said strike plate to said door jamb; thereby mechanically capturing said planar base portion between the edge of said door and said strike plate with said planar barrier portion protruding through said pass-through slot of said strike plate.

2. The door security device according to claim 1, further comprising a first notch formed into the top end of said planar barrier portion, and a second notch formed into the bottom end of said planar barrier portion, said first and second notches configured to prevent access of a jimmy to said latch bolt.

3. The door security device according to claim 1, wherein said hinge is flexible.

4. The door security device according to claim 1, wherein said hinge is resilient.

5. The door security device according to claim 1, wherein the angle formed between the hinged planar base portion and planar barrier portion is in the range of about 30 degrees to 90 degrees.

6. The door security device according to claim 1, further comprising:

(a) a planar top barrier mechanically attached to said planar base portion by means of a top hinge, said planar top barrier configured to prevent access of a jimmy to said latch bolt; and (b) a planar bottom barrier mechanically attached to said planar base portion by means of a bottom hinge, said planar bottom barrier configured to prevent access of a jimmy to said latch bolt.

7. In combination with a door, a door jamb and a latch bolt, a method of using a door security device comprising the steps of:

(a) obtaining a door security device comprising:

(i) a strike plate, said strike plate comprising a striking edge, a pass-through slot, said pass-through slot being an aperture fully enclosed by and passing-through said strike plate, one or more fastener holes, and a latch receiver, said latch receiver disposed between said striking edge and said pass-through slot;

(ii) a barrier plate having a top end and a bottom end, said barrier plate comprising: a planar base portion; a planar barrier portion configured to prevent access of a jimmy to said latch bolt; and a hinge providing mechanical connection between said planar base portion and said planar barrier portion, and positioning said planar barrier portion in a generally perpendicular orientation with respect to said planar base portion; said barrier plate configured to conform to and fill the gap formed between said door and said door jamb upon closing said door; and (iii) one or more fasteners;

(b) installing said door security device into said door jamb by means of said one or more fasteners;

(c) closing said door into said door jamb, thereby causing said planar barrier portion of said door security device to conform to and fill the gap formed between said door and said door jamb upon closing said door, said planar barrier portion being contained between the edge of said door and said door jamb and preventing access of a jimmy to said latch bolt.

8. In combination with a door, a door jamb and a latch bolt, a door security device for preventing the jimmying of a door lock, the device comprising:

(a) a strike plate, said strike plate comprising a striking edge, a pass-through slot, said pass-through slot being an aperture fully enclosed by and passing-through said strike plate, one or more fastener holes, and a latch receiver, said latch receiver disposed between said striking edge and said pass-through slot;

(b) a barrier plate having a top end and a bottom end, said barrier plate comprising:

(i) a planar base portion;

(ii) a planar barrier portion configured to prevent access of a jimmy to said latch bolt; and (iii) a hinge providing mechanical connection between said planar base portion and said planar barrier portion, and positioning said planar barrier portion in a generally perpendicular orientation with respect to said planar base portion;

said planar barrier portion configured to conform to and fill the gap formed between said door and said door jamb upon closing said door;

(c) one or more fasteners; and (d) a first notch formed into the top end of said planar barrier portion, and a second notch formed into the bottom end of said planar barrier portion, said first and second notches configured to prevent access of a jimmy to said latch bolt;

said door security device assembled and installed such that said one or more fasteners mechanically fasten said strike plate to said door jamb; thereby mechanically capturing said planar base portion between the edge of said door and said strike plate with said planar barrier portion protruding through said pass-through slot of said strike plate.

* * * * *